US005997211A

United States Patent [19]

Chou

[11] Patent Number: 5,997,211

[45] Date of Patent: Dec. 7, 1999

[54] STRUCTURE OF GATE BARRIER

[76] Inventor: Pi-Cheng Chou, 2F, No. 333-2, Sec. 2, Shih-Pai Rd., Taipei City, Taiwan

[21] Appl. No.: 09/190,107

[22] Filed: Nov. 12, 1998

Related U.S. Application Data

[63] Continuation-in-part of application No. 09/037,272, Mar. 9, 1998.

[51] Int. Cl.[6] ..... E01F 13/06

[52] U.S. Cl. ..... 404/6; 256/2; 256/13.1

[58] Field of Search ..... 404/6; 256/1, 13.1, 256/2

[56] References Cited

U.S. PATENT DOCUMENTS 4,016,679 4/1977 Ellefson ..... 49/49

4,318,079 3/1982 Dickinson ..... 404/6 X 5,288,164 2/1994 Nasatka ..... 404/10

*Primary Examiner*—James A. Lisehora

*Attorney, Agent, or Firm*—Rosenberg, Klein & Lee

[57] ABSTRACT

A gate barrier includes two parallel posts, a folding collapsible barrier pivoted to one post and turned by a power drive to close/open the passage way between the posts, wherein the folding collapsible barrier has a barbed bottom rail which is supported on the ground to prevent vehicles from passing when the folding collapsible barrier is turned to a horizontal position to close the passage way.

6 Claims, 3 Drawing Sheets

STRUCTURE OF GATE BARRIER

CROSS-REFERENCE TO THE RELATED APPLICATION

The present invention is a continuation-in-part of patent application Ser. No. 09/037,272, filed Mar. 9, 1998, entitled "Gate Barrier".

BACKGROUND OF THE INVENTION

According to U.S. pat. application Ser. No. 09/037,272, the gate barrier comprises a first post, a drive shaft and a driven shaft revolvably supported on the first post at different elevations, a second post disposed in parallel to the first post, the second post having at least one angled holder plate, and a folding collapsible barrier having a fixed end fixedly connected to the drive shaft and the driven shaft and a free end for resting on the at least one holder plate at the second post. The folding collapsible barrier is extended out when lowered to rest its free end on the at least one angled holder plate at the second post. The folding collapsible barrier is collapsed when lifted from the second post to a vertical position in vertical alignment with the first post. This structure of gate barrier is functional, however it cannot prevent vehicles from passing.

SUMMARY OF THE INVENTION

The present invention has been accomplished to provide a gate barrier which eliminates the aforesaid problem. It is the main object of the present invention to provide a gate barrier which effectively prevents people and vehicles from passing. According to one aspect of the present invention, the gate barrier comprises a first post and a second post arranged in parallel, a power drive installed in the first post, and a folding collapsible barrier pivoted to the first post and turned by the power drive to close/open the passage way between the posts. The folding collapsible barrier is comprised of a top rail, a bottom rail, and a link coupled between the top rail and the bottom rail. The bottom rail has a barbed structure which is supported on the ground to prevent vehicles from passing when the folding collapsible barrier is turned to a horizontal position to close the passage way. According to another aspect of the present invention, explosive means may be mounted in the bottom rail which explodes when run over by a vehicle. According to still another aspect of the present invention, a folding collapsible grille may be coupled between the top rail and the bottom rail to prevent small animals from passing.

DETAILED DESCRIPTION OF THE PRESENT INVENTION

Figures 1A, 1B, 1C:
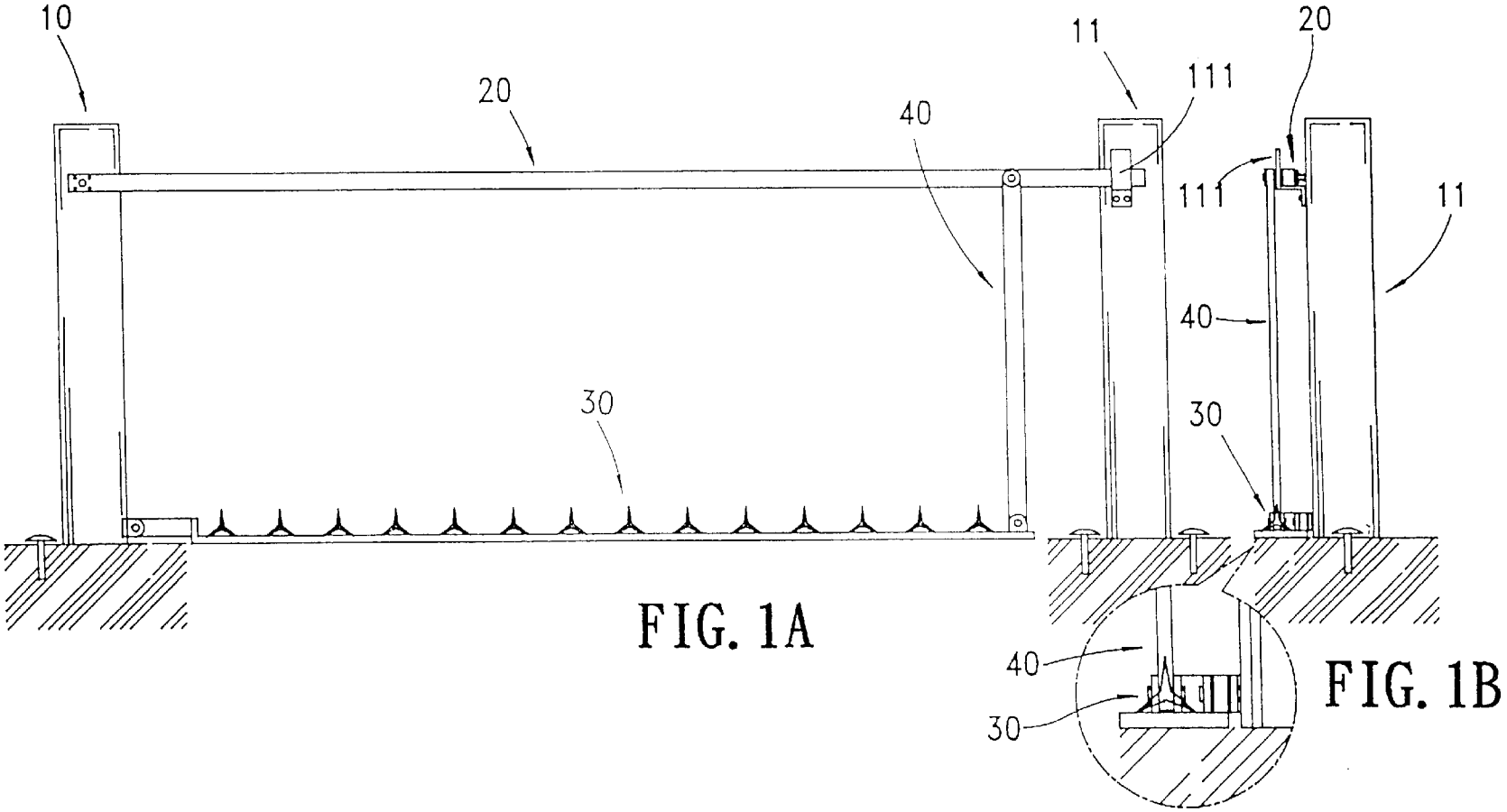
FIG. 1A is a front elevational view of a gate barrier according to the present invention.
FIG. 1B is another elevational view of the gate barrier of FIG. 1A when viewed from another angle.
FIG. 1C is an enlarged view of a part of FIG. 1B.

Referring to FIGS. 1A, 1B and 1C, a gate barrier in accordance with the present invention is generally comprised of a first post 10, a second post 11, and a folding collapsible barrier mounted between the first post 10 and the second post 11 to prevent people and vehicles from passing. A power drive (not shown) is mounted in the first post 10. A retainer 111 is mounted on the second post 11 near its top side. The folding collapsible barrier comprises a top rail 20, a barbed bottom rail 30, and a link 40. The top rail 20 has a fixed end pivoted to the first post 10 near the top end of the first post 10, and a free end. The barbed bottom rail 30 has a fixed end pivoted to the bottom end of the first post 10. The link 40 has a top end pivoted to the free end of the top rail 20, and a bottom end pivoted to the free end of the barbed bottom rail 30. When the top rail 20 is turned toward the second post 11 to a horizontal position, the endpiece of the free end of the top rail 20 is secured to the retainer 111 at the second post 11, and the barbed bottom rail 30 is synchronously turned with the top rail 20 to a horizontal position and firmly supported on the ground. Because the barbed bottom rail 30 has upright barbs, it effectively prevent vehicles from passing when supported on the ground.

Figure 2:
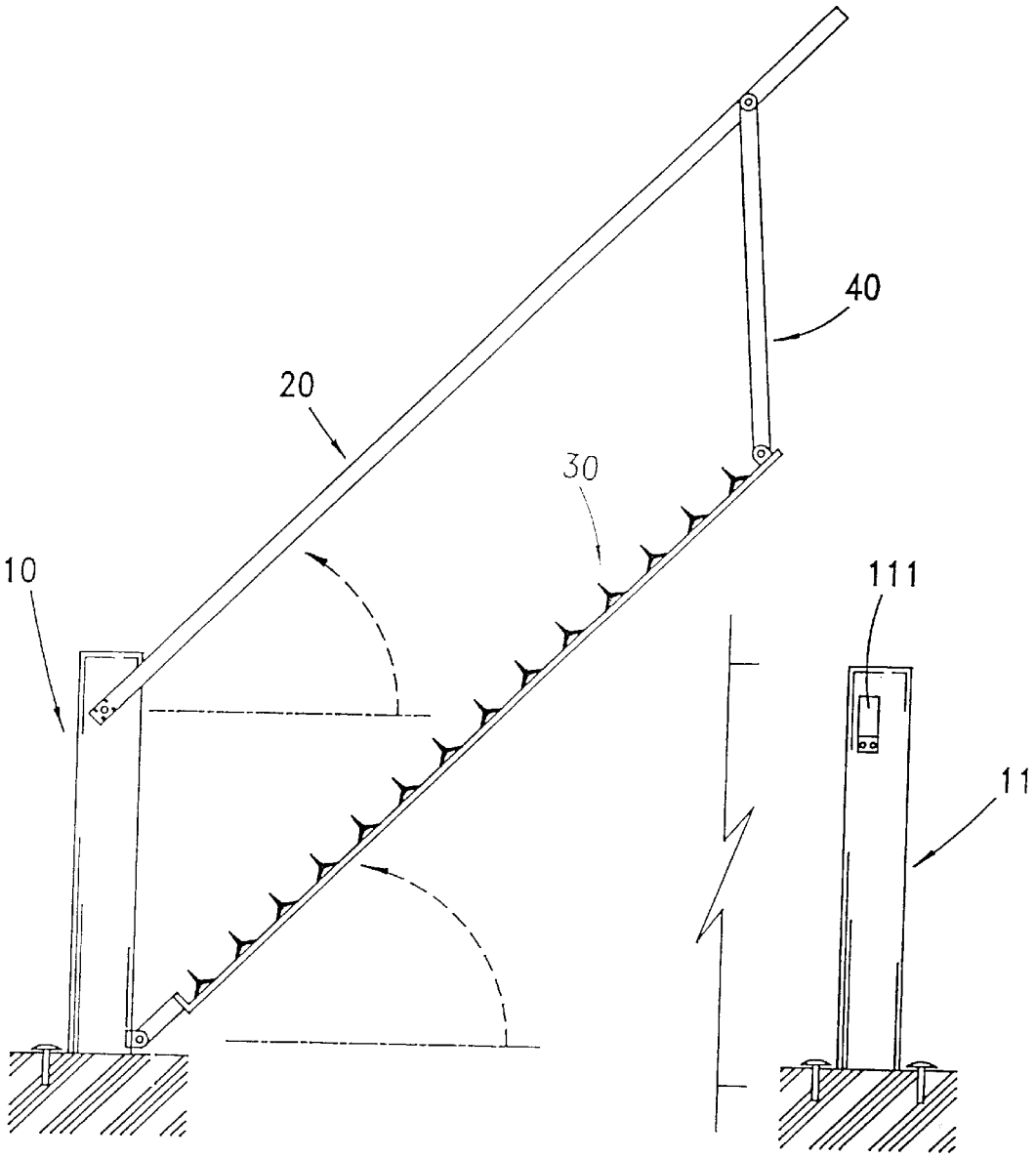
FIG. 2 is an applied view of the present invention, showing the folding collapsible barrier lifted from retainer at the second post.
Figure 3:
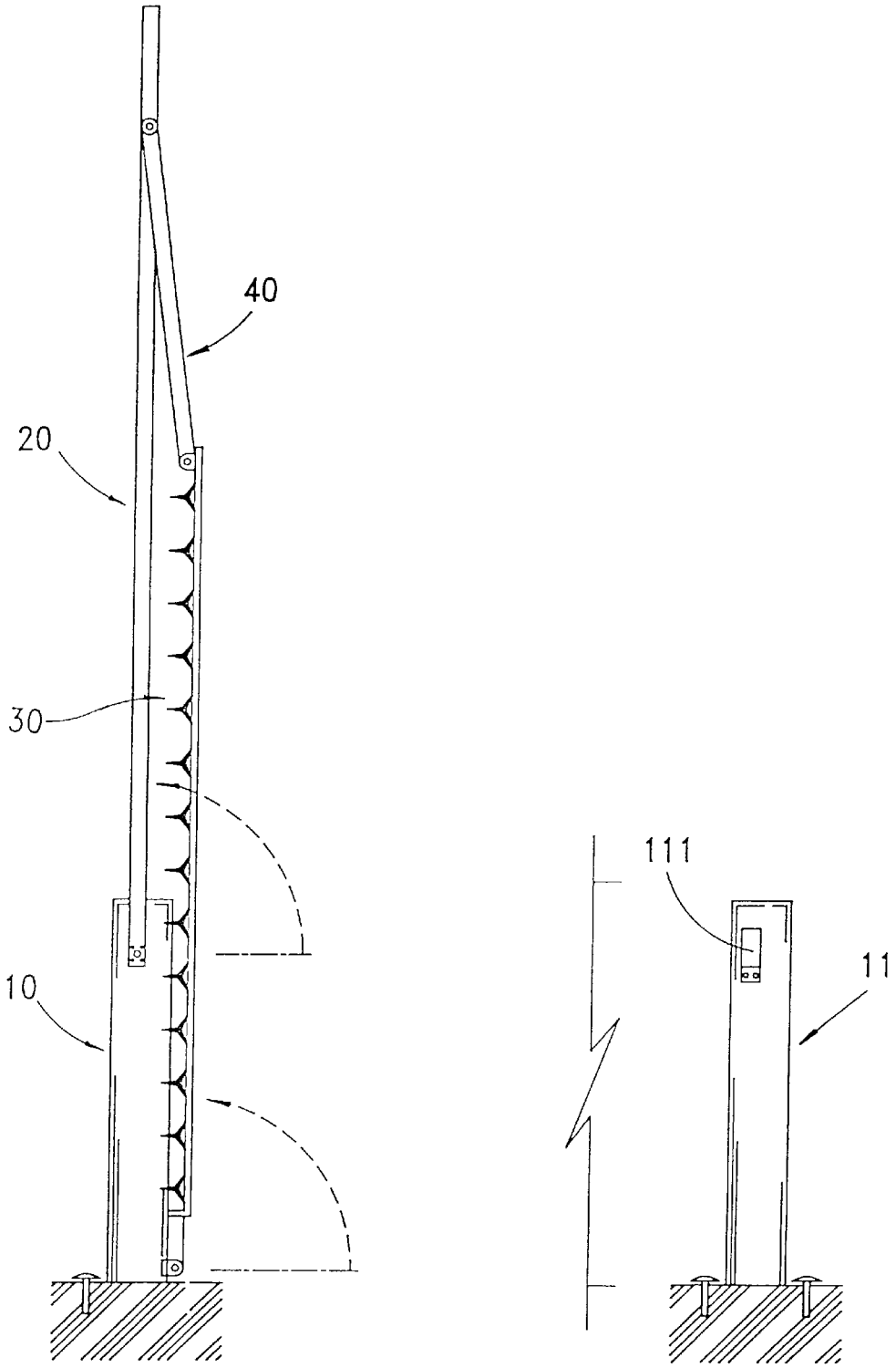
FIG. 3 illustrates the folding collapsible barrier lifted to the vertical position in vertical alignment with the first post and collapsed according to the present invention.

Referring to FIGS. 2 and 3, when the top rail 20 is turned upwards from the second post 11 to a vertical position by the power drive (for example, motor drive or hydraulic transmission system) in the first post 10, the link 40 is turned downwards, and the barbed bottom rail 30 is moved with the link 40 and lifted from the ground, and therefore the folding collapsible barrier is lifted and collapsed, and the gate is opened for letting people and vehicles pass.

The aforesaid gate barrier can be installed in a particular place, for example, a military base, a runway in an airfield, a jail or an ammunition depot.

It is to be understood that the drawings are designed for purposes of illustration only, and are not intended as a definition of the limits and scope of the invention disclosed, and various modifications and changes could be made thereunto without departing from the spirit and scope of the invention. For example, the bottom rail 30 can be provided with nails, sharp hooks, or any of a variety of points. Alternatively, explosive means may be provided at the bottom rail 30. Furthermore, a folding collapsible grille may be coupled between the top rail 20 and the bottom rail to prevent small animals from passing.

What the invention claimed is:

1. A gate barrier comprising:

a first post having a bottom end fastened to the ground and a top end;

a second post having a bottom end fastened to the ground and a top end fixedly mounted with a retainer;

a top rail having a fixed end pivoted to the top end of said first post and a free end;

a bottom rail having a fixed end pivoted to the bottom end of said first post adjacent to the ground and a free end;

a link coupled between the free end of said top rail and the free end of said bottom rail; and a power drive installed in said first post and controlled to turn said top rail between a horizontal position where the free end is secured to the retainer at said second post, and a vertical position where said link and said bottom rail are closely attached to said top rail;

wherein said bottom rail has a barbed structure which is supported on the ground to prevent vehicles from passing when said top rail is turned by said power drive to the horizontal position and the free end of said top rail is secured to the retainer at said second post.

2. The gate barrier of claim 1 wherein said barbed structure of said bottom rail comprises a plurality of nails spaced along the length of said bottom rail.

3. The gate barrier of claim 1 wherein said barbed structure of said bottom rail comprises a plurality of sharp hooks spaced along the length of said bottom rail.

4. The gate barrier of claim 1 wherein said barbed structure of said bottom rail comprises a plurality of barbs spaced along the length of said bottom rail.

5. The gate barrier of claim 1 further comprising explosive means mounted in said bottom rail which explodes when run over by a vehicle.

6. The gate barrier of claim 1 further comprising a folding collapsible grille coupled between said top rail and said bottom rail.

* * * * *